United States Patent [19]

Holmes

[11] 4,004,542

[45] Jan. 25, 1977

[54] WATERJET PROPELLED PLANING HULL

[76] Inventor: William H. Holmes, 931 Sunset Drive, Costa Mesa, Calif. 92627

[22] Filed: June 3, 1975

[21] Appl. No.: 583,283

Related U.S. Application Data

[63] Continuation-in-part of Ser. No. 341,886, March 16, 1973, abandoned.

[52] U.S. Cl. ..... 115/14; 9/6 R

[51] Int. Cl.[2] ..... B63H 11/02

[58] Field of Search ..... 115/11, 12 R, 14–16, 115/70; 9/6; 114/56, 66.5 R, 66.5 P, 67 A, 151

[56] References Cited

UNITED STATES PATENTS

| | | | |
|---|---|---|---|
| 3,038,179 | 6/1972 | Wagemaker | 9/6 |
| 3,363,598 | 1/1968 | Mortrude | 114/56 |
| 3,600,733 | 8/1971 | Lippisch | 9/6 |
| 3,623,447 | 11/1971 | Jacobson | 115/70 |
| 3,776,168 | 12/1973 | Weeks | 114/66.5 P |
| 3,911,846 | 10/1975 | England | 115/12 R |

*Primary Examiner*—George E. A. Halvosa
*Assistant Examiner*—Jesus D. Sotelo
*Attorney, Agent, or Firm*—Fulwider, Patton, Rieber, Lee & Utecht

[57] ABSTRACT

A boat for use with a waterjet propulsion unit. The boat includes a planing hull having a generally V-shaped bottom formed at its mid-portion with a depending flat-bottomed support pod that houses the lower part of the propulsion unit. The sides and intermediate portions of the boat bottom are provided with depending, longitudinally extending, stabilizing strakes that provide advantages not found in conventional waterjet propelled boats.

3 Claims, 16 Drawing Figures

FIG. 12
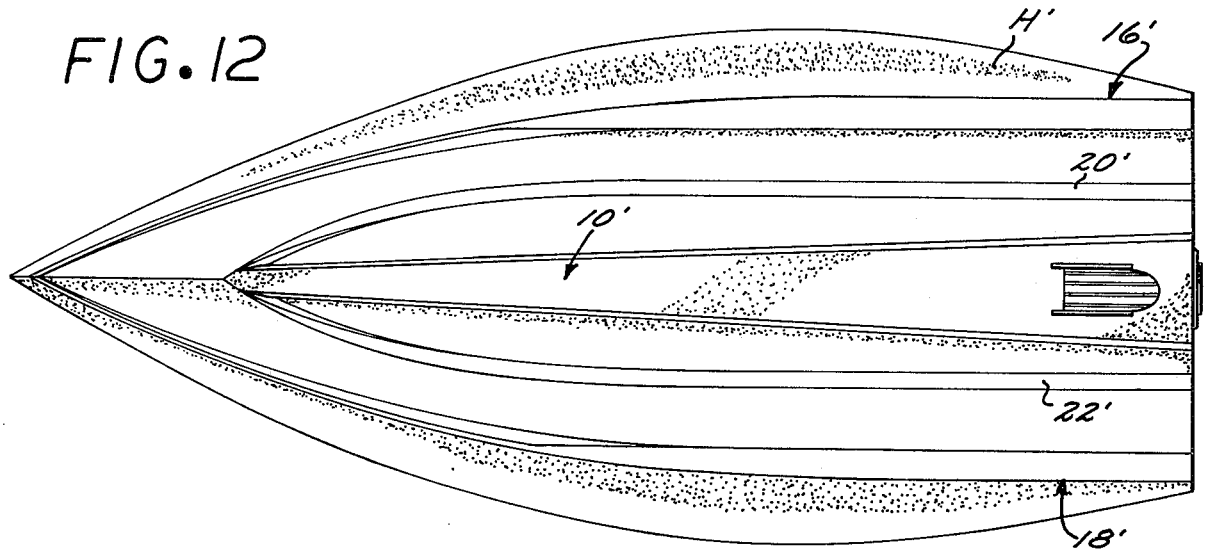
FIG. 13
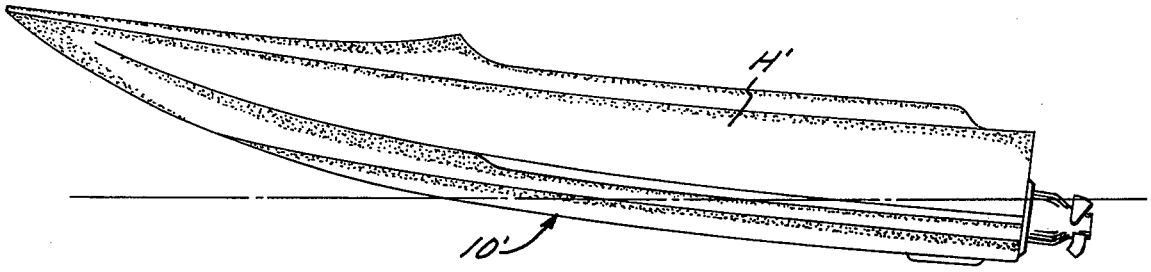
FIG. 14
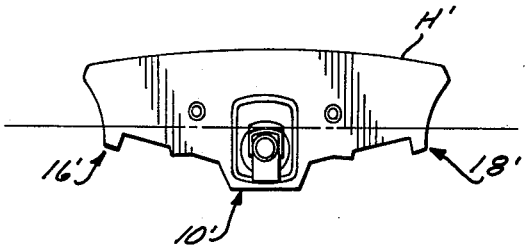
FIG. 16
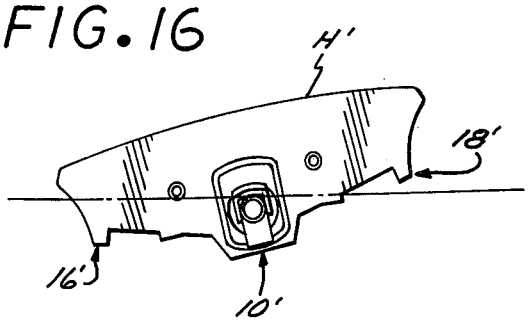
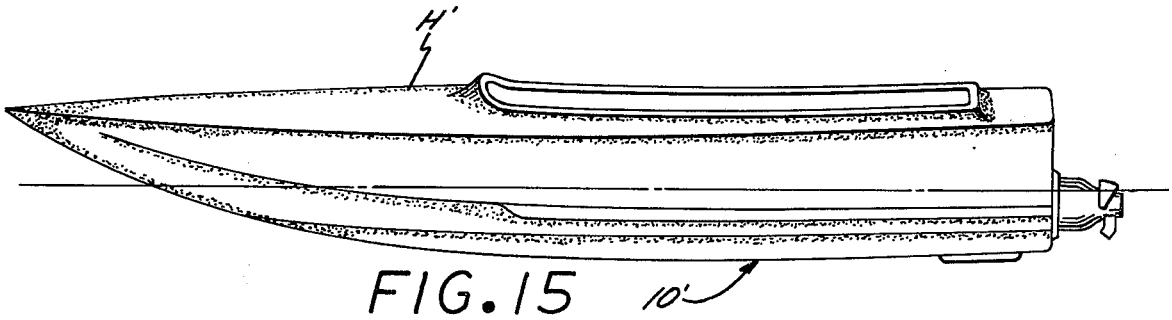
FIG. 15

WATERJET PROPELLED PLANING HULL

This is a continuation-in-part of my copending application Ser. No. 341,886 filed Mar. 16, 1973, now abandoned.

BACKGROUND OF THE INVENTION

1. Field of the Invention

The present invention relates generally to the art of boat construction and more particularly, a waterjet propelled boat.

2. Description of the Prior Art

It is a major disadvantage of conventional planing waterjet propelled boats that they readily spin-out when encountering natural or man made waves, particularly during a turn. This tendancy to spin-out is enhanced by the fact that the more power applied by the jet propulsion unit, the farther out of the water the boat transom rides. As the transom rises, the nozzle of the jet likewise rises and therefore loses its water expelling capability. This in turn results in a loss of the control normally afforded by the jet propulsion unit. Thus, when a conventional planing hull boat engages a wave, the waterjet will often be momentarily robbed of water thereby resulting in consequent loss of power and control, giving rise to a spin-out. Certain planing hull boats also have a tendency to dig in their bows at high speeds.

SUMMARY OF THE INVENTION

It is a major object of the present invention to provide a planing waterjet propelled boat which is resistant to spinning-out when encountering waves.

An additional object of the present invention is to provide a waterjet propelled boat of the aforedescribed nature utilizing a center support pod which houses the lower portion of the waterjet propulsion unit, such boat also being provided with depending, longitudinally extending, stabilizing strakes along the major portion of the underside of its hull. At normal speeds the boat will ride on the support pod, with the stabilizing strakes providing lateral resistance against spin-out.

A further object of the present invention is to provide a waterjet propelled boat of the aforedescribed nature which is not appreciably more costly than conventional boat constructions of the waterjet propelled type.

Yet another object of the present invention is to provide a waterjet propelled boat of the aforedescribed nature which additionally incorporates depending intermediate strakes between the support pod and the stabilizing strakes, with an air cushion being generated between the intermediate and the stabilizing strakes.

Yet a further object of the present invention is to provide a waterjet propelled boat that is so configured as to be resistant to digging in of its bow.

These and other objects and advantages of the present invention will become apparent from the following detailed description, when taken in conjunction with the appended drawings.

DESCRIPTION OF THE DRAWINGS

FIG. 12 is a bottom view of the boat of FIG. 9;

FIG. 13 is a side elevational view of the boat of FIG. 9 showing the boat afloat;

FIG. 14 is a rear elevational view of the boat shown in FIG. 13;

FIG. 15 is a side view similar to FIG. 13, but showing said boat performing a turn; and FIG. 16 is a rear view of the boat shown in FIG. 15.

DESCRIPTION OF THE PREFERRED EMBODIMENT

Figure 1:
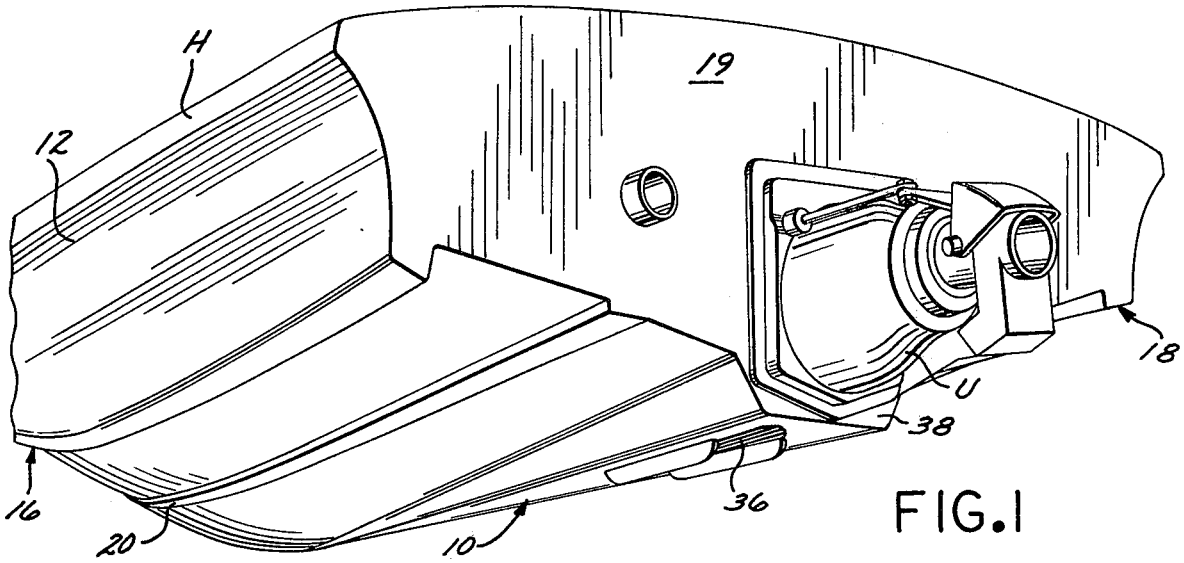
FIG. 1 is a broken perspective view showing the rear and underside of a first form of a waterjet propelled boat embodying the present invention.
Figure 2:
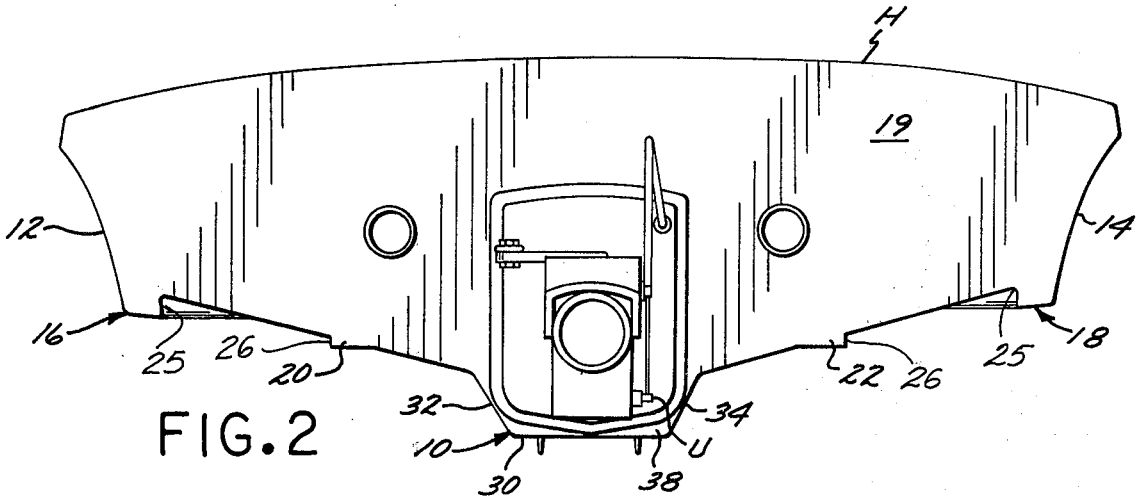
FIG. 2 is a rear elevational view of said boat.
Figure 3:
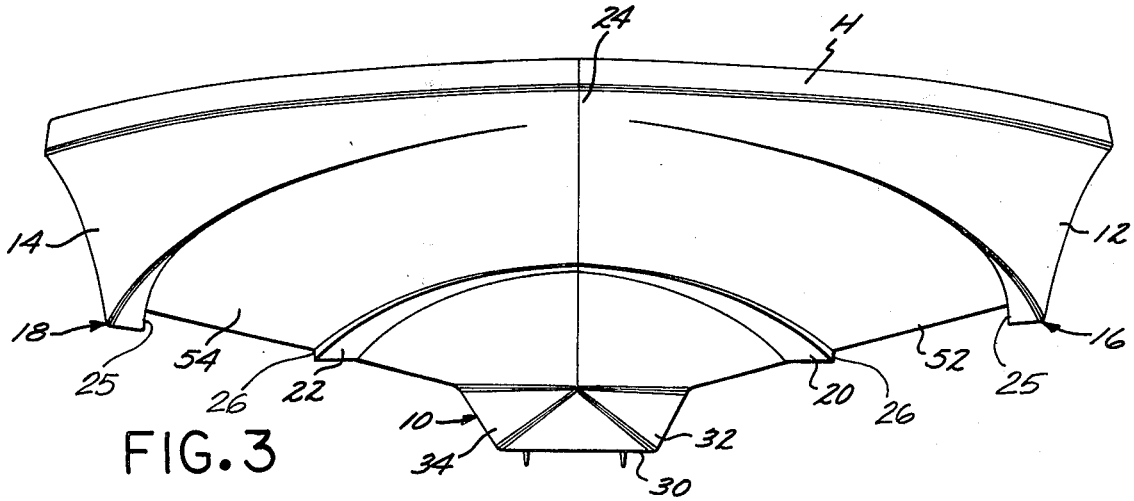
FIG. 3 is a front view of said boat.
Figure 4:
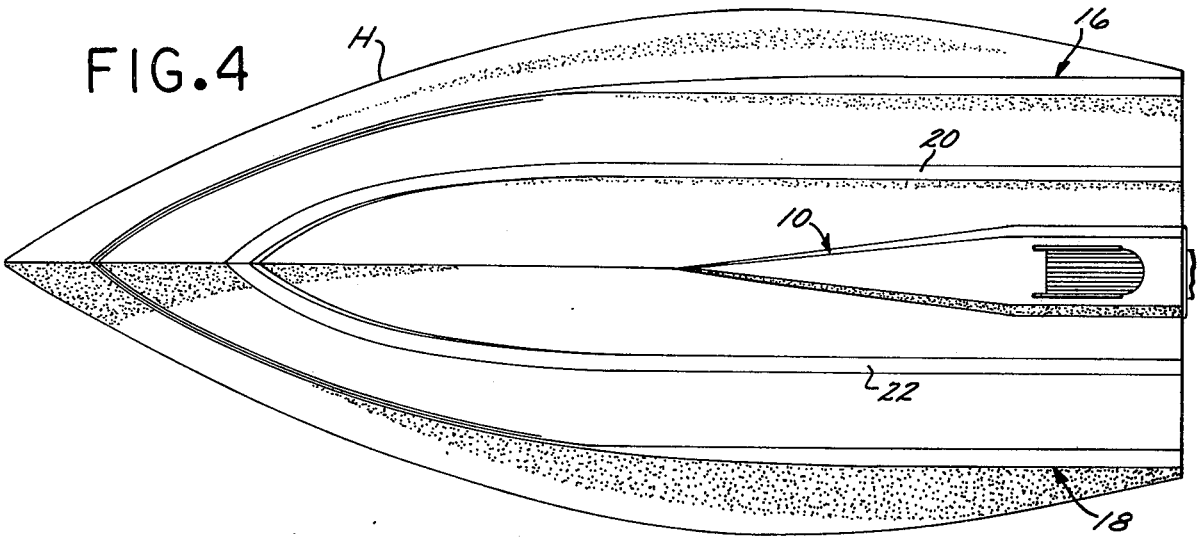
FIG. 4 is a bottom view of said boat.

Referring to FIGS. 1 through 7 of the accompanying drawings, there is shown a first form of boat construction embodying the present invention that includes planing boat hull H, provided with a conventional waterjet propulsion unit U at its rear portion. The underside of hull H is of a generally flat or soft V-shaped configuration formed at its mid-portion with a depending support pod, generally designated 10, that receives the lower part of waterjet propulsion unit U. The outer sides 12 and 14 of hull H are formed with a pair of depending, stabilizing strakes or sponsons, generally designated 16 and 18, that extend longitudinally from the transom 19 to the bow portion of the hull along the major length of such hull. The underside of the hull H is also provided with a pair of intermediate, depending strakes 20 and 22, which extend longitudinally from transom 19 to the bow portion 24 of the hull along the major length of the latter. The inner surfaces 25 of strakes 16 and 18 and the outer surfaces 26 of strakes 20 and 22 are substantially vertically extending.

More particularly, the hull H will be preferably of fiberglass construction, although other suitable material may be utilized in its construction. The aforementioned support pod 10 includes a flat underside 30 and a pair of outwardly and upwardly extending sidewalls 32 and 34. It will be noted that the rear portion of pod 10 extends generally parallel to the length of hull H and is provided at its underside with a water intake 36 for the waterjet propulsion unit U. The support pod 10 tapers forwardly and inwardly to approximately the mid-portion of the length of hull H. The rear end wall 38 of the support pod 10 is contiguous with the hull transom 19.

The stabilizing strakes 16 and 18 are mirror images of one another and are seen to taper forwardly and inwardly from transom 19 to the bow portion 24 of the hull. Similarly, the intermediate strakes 20 and 22 also taper forwardly and inwardly from transom 19 to the front portion of hull H. The support pod 10, stabilizing strakes 16 and 18 and intermediate strakes and 20 and 22 are preferably integral with the hull H.

Figure 5:
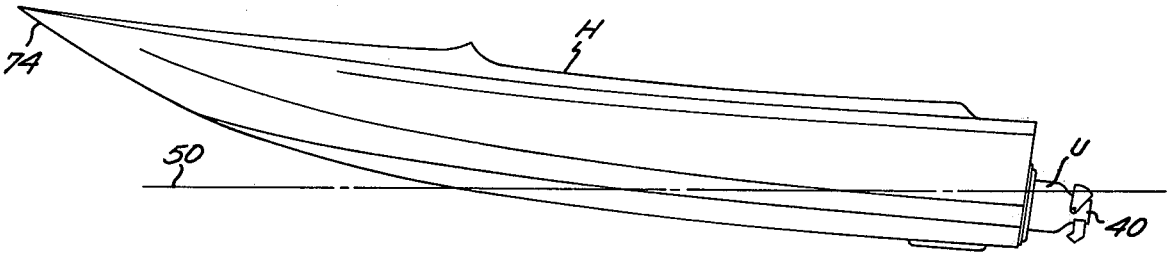
FIG. 5 is a side elevational view of said boat, showing the boat afloat.
Figure 6:
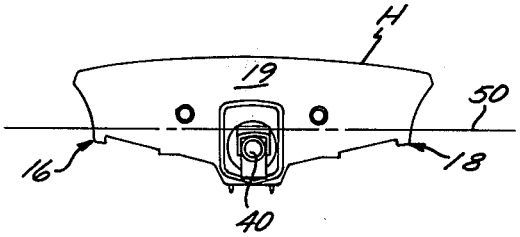
FIG. 6 is a rear view of the boat shown in FIG. 5.

In the operation of the aforedescribed boat and referring first particularly to FIG. 5 and 6, during forward motion of the hull H at cruising speed, the transom will rise and the bow lower until the hull assumes the position of these figures since at this time the hull weight will be supported primarily by the support pod 10. The more power applied by unit U, the higher the transom will rise. It should also be noted that in this position, the discharge nozzle 40 of the propulsion unit U is below the water surface 50. Also, at this time the pointed bow ends of the stabilizing strakes 16 and 18 and of the intermediate strakes 20 and 22 provide a smooth flow of water rearwardly over the underside of the hull. Moreover, an air cushion is generated between the spaces 52 and 54, separating intermediate strake 22 and stabilizing strake 18. The double slot provided by spaces 52 and 54 allows both air and water to be trapped under the hull, which in practice appears to produce six important performance characteristics, as follows:

1. The trapped air provides lift for the entire hull at high speeds, thereby providing faster boat speeds for a given power output of the propulsion unit U while affording an easier ride for the occupants of the boat.
2. The compressed water beneath the double slots creates water packing around the pump inlet in tight turns thereby preventing an inadvertent power loss and a consequent spin-out.
3. The generally vertical surfaces 25 and 26 of strakes 16, 18 and 20, 22 afford lateral resistance against skidding into a spinning-out.
4. The stabilizing outer sponsons by increasing displacement as they are depressed into the water prevent excessive hull lean in corners.
5. Low speed tracking and maneuverability is improved.
6. The traditional soft V-bottom ride has not been disturbed because no significant flatbottom surfaces have been created.

It is important to note that disposing the lower portion of the propulsion unit U within the support pod 10 serves to dispose the nozzle 40 of the propulsion unit at the farthest possible distance below the designed water level 50. The designed water level may be considered as the water level of a boat carrying the number and weight of passengers specified by the manufacturer of the boat. The lowered position of the propulsion unit U as compared to prior art boat constructions results in a lower center of gravity for the hull, thereby improving the stability thereof.

Figure 8:
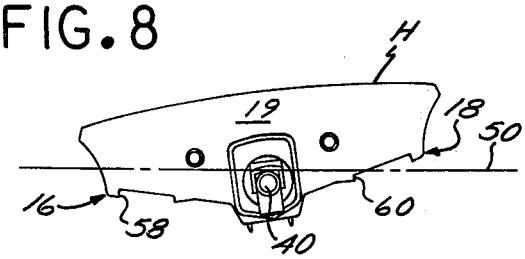
FIG. 8 is a rear view of the boat shown in FIG. 7.
Figure 7:
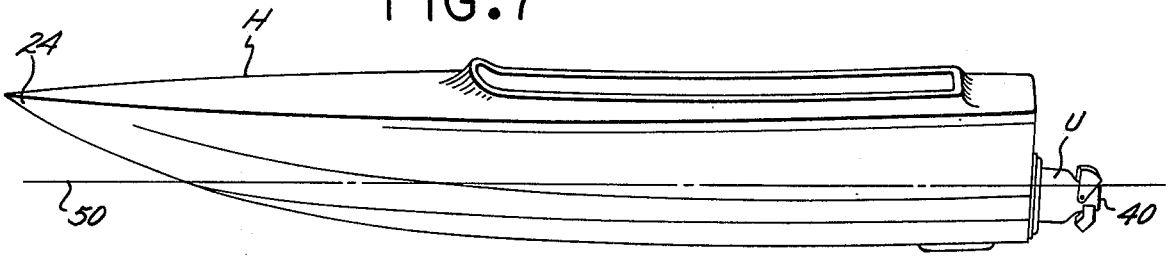
FIG. 7 is a side view similar to FIG. 5, but showing said boat performing a turn.

Referring now to FIGS. 7 and 8, assuming the boat engages in a turning maneuver, it will roll towards the position indicated in these two figures. In this position, the inner surfaces 58 of the stabilizing strake 16 provides appreciable lateral resistance against sideward movement of the hull to the right, in FIG. 8, thereby preventing a spin-out. The right-hand side surface 60 of the intermediate rib 20 will provide additional lateral resistance. It will be understood that such resistance to spin-out will be provided without any appreciable increase in the cost of construction of the hull, nor in any appreciable lowering of the boat's forward speed.

Figure 9:
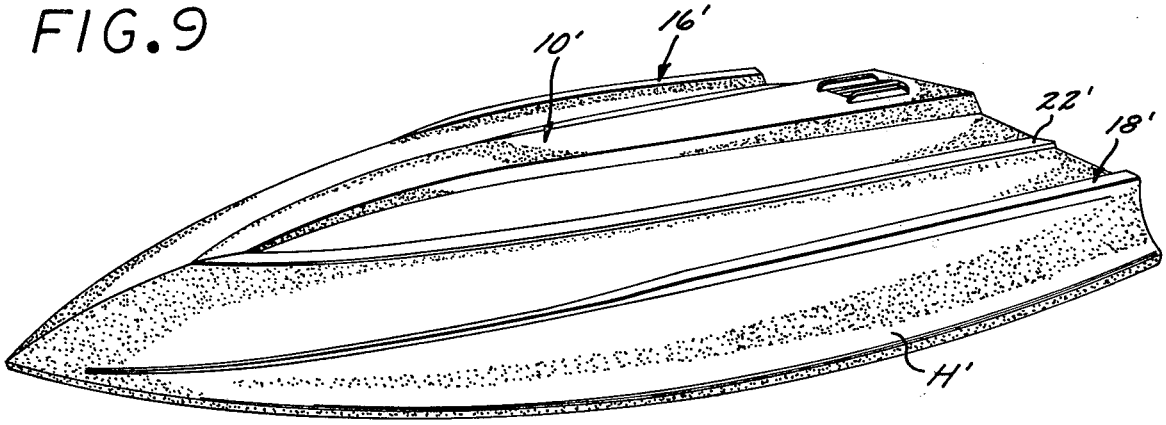
FIG. 9 is a perspective view showing the underside of a second form of waterjet propelled boat embodying the present invention.
Figure 10:
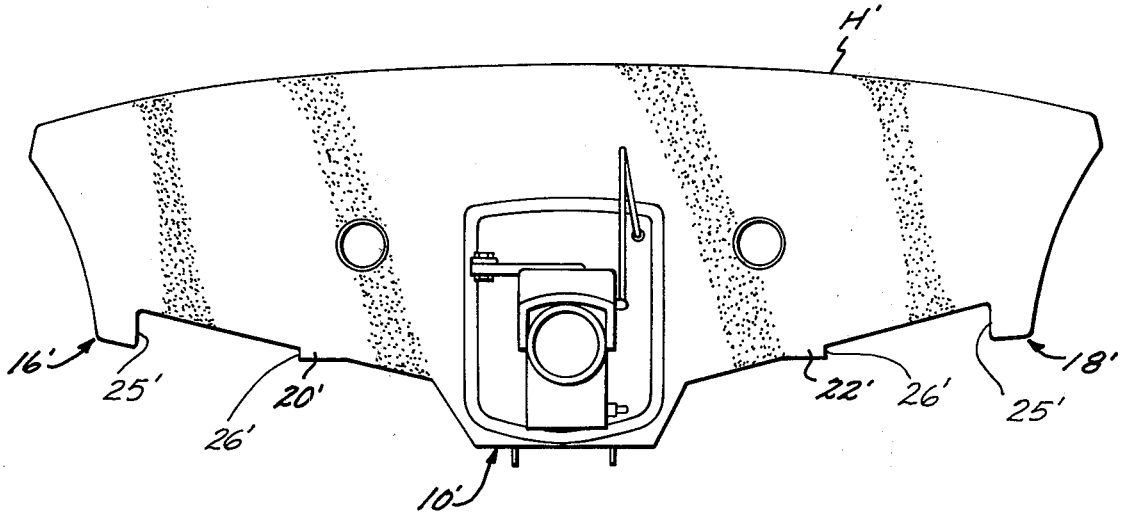
FIG. 10 is a rear elevational view in enlarged scale of the boat shown in FIG. 9.
Figure 11:
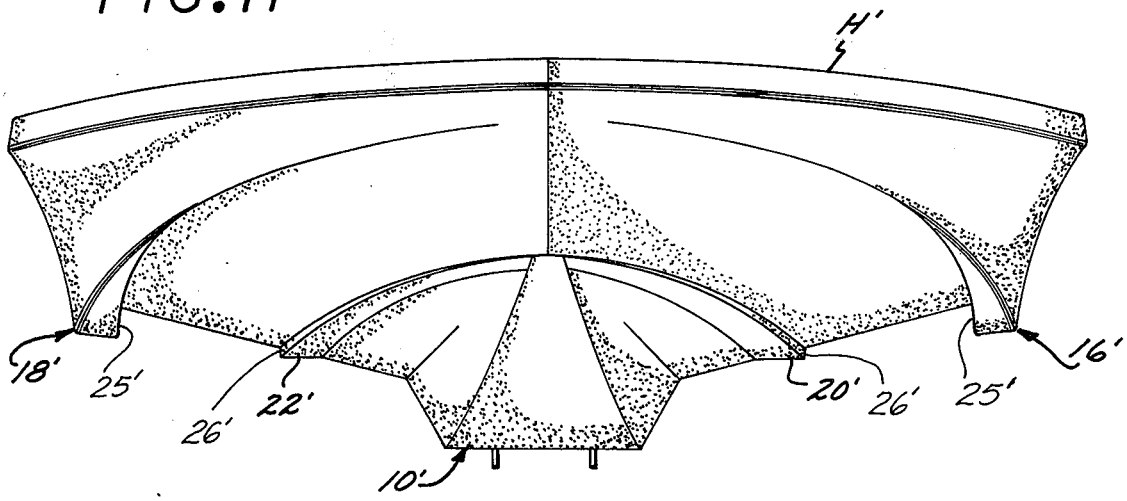
FIG. 11 is a front view of the boat of FIG. 9.

Referring now to FIGS. 9 through 15 of the accompanying drawings, there is shown a second form of waterjet propelled boat embodying the present invention, with like parts bearing primed reference numerals. The second form of boat is generally similar in configuration and operation to the form of FIGS. 1 through 8. It should be noted, however, that the support pod 10' runs farther forward along the underside of the hull H' than the above-described support pod 10. Additionally, support pod 10' is wider than support pod 10. The provision of the modified support pod 10' affords additional hull lift coupled with better handling characteristics. Thus, as indicated in FIGS. 9 and 12, the support pod 10' affords a flat horizontal surface that extends from the transom to the front portion of the hull where such flat surface joins the outwardly and rearwardly directed intermediate strakes 20' and 22'. This extended flat surface provides a "riding" surface that supports the major portion of the hull H, its engine and the passengers. In practice it has been determined that the front end of support pod 10' should extend forwardly from the boat's transom at least 80 percent of the total hull length.

It should also be noted that the stabilizing sponsons 16' and 18' extend deeper into the water than the stabilizing strakes or sponsons 16 and 18 of the boat of FIGS. 1–8. As indicated in FIGS. 15 and 16, such lowered stabilizing sponsons dig into the water during sideward movement of the hull so as to exert considerable lateral resistance against sideward movement of the hull thereby effectively resisting a spin-out.

Various modifications and changes may be made with respect to the foregoing detailed description without departing from the spirit of the present invention.

I claim:

1. A planing boat hull for use with a waterjet propulsion unit having a downwardly-facing water intake and a rearwardly directed discharge nozzle, said boat hull comprising:

a generally flat V-shaped bottom;

a depending support pod extending forwardly from the transom of said hull, said support pod having a flat underside and a pair of upwardly extending sidewalls, said support pod receiving the lower portion of said waterjet propulsion unit, with the water intake of said unit being provided at the underside of said support pod;

a pair of depending stabilizing strakes extending longitudinally along the major length of said hull from the transom thereof, with the inwardly-facing side surfaces of said strakes being substantially vertically extending so as to provide lateral resistance against sideward movement of said hull during forward travel thereof, the flat underside of said support pod primarily supporting the weight of said boat at planing speeds of said boat, but with said pod extending into the water sufficiently so that the discharge nozzle of said propulsion unit is below the water level at planing speeds; and a pair of intermediate depending strakes which extend longitudinally along said bottom of the hull, said intermediate strakes being disposed between the opposite sides of said support pod and the stabilizing strakes whereby an air cushion is generated between the spaces separating each intermediate strake and the inwardly facing side of the stabilizing strake proximate thereto, and with the outer sides of said intermediate strakes being generally vertically extending so as to provide additional lateral resistance against sideward movement of said hull during forward travel thereof.

2. A planing boat hull as set forth in claim 1 wherein: the front ends of said support pod and said stabilizing strakes merge.

3. A planing boat hull as set forth in claim 2 wherein: said support pod extends forwardly from the rear end of said hull at least 80 percent of the total length of said hull.

* * * * *